US009487841B2

(12) United States Patent
Williams

(10) Patent No.: US 9,487,841 B2
(45) Date of Patent: Nov. 8, 2016

(54) LINEPIPE STEEL

(75) Inventor: James Geoffrey Williams, Balgownie (AU)

(73) Assignee: Bluescope Steel Limited, Melbourne (AU)

( * ) Notice: Subject to any disclaimer, the term of this patent is extended or adjusted under 35 U.S.C. 154(b) by 0 days.

(21) Appl. No.: 12/889,799

(22) Filed: Sep. 24, 2010

(65) Prior Publication Data

US 2011/0011834 A1 Jan. 20, 2011

Related U.S. Application Data

(62) Division of application No. 11/816,711, filed as application No. PCT/AU2006/000219 on Feb. 21, 2006, now abandoned.

(30) Foreign Application Priority Data

Feb. 21, 2005 (AU) ..... 2005900795

(51) Int. Cl.

| | |
|---|---|
| ***C21D 8/02*** | (2006.01) |
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/12*** | (2006.01) |
| ***C22C 38/14*** | (2006.01) |

(52) U.S. Cl.

CPC ..... *C21D 8/0226* (2013.01); *C21D 8/10* (2013.01); *C22C 38/001* (2013.01); *C22C 38/02* (2013.01); *C22C 38/04* (2013.01); *C22C 38/12* (2013.01); *C22C 38/14* (2013.01); *C21D 8/105* (2013.01)

(58) Field of Classification Search

CPC ..... C21D 8/0226; C21D 8/10; C21D 8/105; C22C 38/001; C22C 38/02; C22C 38/04

USPC ..... 164/76.1; 219/67

See application file for complete search history.

(56) References Cited

U.S. PATENT DOCUMENTS 4,533,405 A * 8/1985 Sponseller et al. ..... 148/337
5,993,570 A * 11/1999 Gray ..... 148/320

(Continued)

FOREIGN PATENT DOCUMENTS

| | | |
|---|---|---|
| JP | 82/77746 E/37 | 8/1982 |
| JP | 83-762431/37 | 8/1983 |
| JP | 58-161722 | 9/1983 |

(Continued)

OTHER PUBLICATIONS

PCT/AU2006/000219 International Search Report dated Mar. 10, 2006 (3 pages).

*Primary Examiner* — Alexander Polyansky

(74) *Attorney, Agent, or Firm* — Michael Best & Friedrich LLP

(57) ABSTRACT

A method of producing coil plate on a hot strip mill is disclosed. The method includes coiling hot rolled coil plate strip at a temperature that is selected (a) to minimize precipitation of Cr/Mo carbides or (b) so that any Cr/Mo carbides that form are sufficiently fine that they go into solution in any subsequent heat treatment of coil plate made from the strip.

19 Claims, 1 Drawing Sheet

Low Levels of Segregation in Low Mn Steel compared with High Mn Steel

(56) References Cited

U.S. PATENT DOCUMENTS

| | | | | |
|---|---|---|---|---|
| 6,110,299 | A | 8/2000 | Tosaka et al. | |
| 6,248,187 | B1 | 6/2001 | Asahi et al. | |
| 2004/0187982 | A1* | 9/2004 | Nakata et al. | 148/653 |
| 2004/0234715 | A1* | 11/2004 | Gandy | 428/36.9 |
| 2009/0104069 | A1 | 4/2009 | Williams | |

FOREIGN PATENT DOCUMENTS

| | | |
|---|---|---|
| JP | 86-209665/32 | 7/1986 |
| JP | 2002/602759/65 | 5/2002 |
| KR | 2003/798630/75 | 7/2003 |
| WO | 98/53110 | 11/1998 |
| WO | 2004/106572 | 12/2004 |

* cited by examiner

Low Levels of Segregation in Low Mn Steel compared with High Mn Steel

LINEPIPE STEEL

CROSS-REFERENCE TO RELATED APPLICATIONS

This patent application is a divisional patent application of U.S. patent application Ser. No. 11/816,711 filed on Aug. 21, 2007, now abandoned, which is national stage filing under 35 U.S.C. 371 of International Application No. PCT/AU2006/000219 filed on Feb. 21, 2006, which claims the benefit of priority to Australian Patent Application No. 2005900795 filed on Feb. 21, 2005. Priority to each application is hereby claimed.

FIELD OF THE INVENTION

The present invention relates to linepipe steel, a method of producing linepipe steel strip, a method of producing linepipe from linepipe steel strip, and a linepipe complying with the specified requirements of the API 5L Grades made from linepipe steel.

BACKGROUND

In Australia, the electric resistance welding (ERW) method is the principal method for linepipe manufacture. ERW requires steel strip feed that has been sourced from a hot strip mill. ERW involves heating side edges of strip to temperatures above the melting point of the steel and thereafter butting and thereby welding the side edges together.

Mn levels in linepipe steels produced by the applicant have historically been in the range of 0.8-1.5 wt. %. The main purpose of the Mn addition is to provide solid solution strengthening.

However, one disadvantage of Mn is that it has strong segregating tendencies that typically manifest in anomalous microstructures (with high hardness and low toughness) at the centreline of strip produced by hot rolling continuously cast steel slabs.

Such anomalous microstructures can have deleterious effects on the mechanical properties of the ERW weld line particularly when linepipes are produced from centre slit strip feed. Specifically, the step of butting side edges of strip together in ERW diverts Mn rich centreline segregation bands at the slit side edge of strip into the plane of the weld that forms. The result is to compromise the toughness of the weld line.

Such anomalous microstructures arising from centreline segregation can also have deleterious effects on welds produced by welding together aligned ends of linepipes during construction of a line using upset welding processes such as MIAB and flash butt welding. These processes involve induction heating the rims of the aligned ends by and then butting the ends together to produce autogenous welds. Currently the MIAB welding process, which has some operational and economical advantages over conventionally used manual welding of line pipe, is not used widely in pipe line construction.

The adverse effect of centreline segregation is exaggerated by the coincident occurrence of elongated MnS inclusions in the strip. The plasticity of MnS inclusions in the hot rolling process increases directly with increasing Mn level. The detrimental effects of MnS inclusions on ductile fracture propagation resistance of pipeline steels are well known. These inclusions exert a controlling influence on the fracture toughness of both the pipe body and the weld line. The adverse effect on the weld line toughness is particularly evident for the case of pipes made from centre slit strips.

Traditionally, the adverse effects of elongated MnS inclusions and centreline segregation have been controlled by limiting S concentrations in steel to be below 0.005% (or even lower limits) depending on the specific requirements of a pipeline.

In addition, some steel manufacturers, as an additional countermeasure, have the capability to achieve complete sulphide shape control using Ca injection processes.

However, there are significant capital and operating costs associated with both of the above measures, and the measures are not attractive options for these reasons.

SUMMARY

The present invention provides an alternative solution that is based on composition selection of linepipe steel that should not involve significant additional capital and operating expenditure. In addition to making it possible to produce improved quality linepipe, the linepipe steel is also specifically suited to on-site upset welding processes such as the MIAB and flash butt welding processes.

The solution is to use a steel having (a) a considerably reduced concentration of Mn (typically no more than 0.50 wt. %, preferably no more than 0.35%) than used conventionally for linepipe manufacture and (b) a small concentration of Ti (typically at least 0.01 wt. %).

Furthermore, for higher strength API linepipe grades, the solution may include additions of Cr in the steel. The applicant has found that alloying additions of Cr can also be effective in increasing the hardness and reducing the plasticity of MnS inclusions. In general, the specification toughness requirements of linepipe steels increase with increasing strength levels. For the higher strength API linepipe grades, the use of Cr additions in place of Mn will have the combined benefit of contributing to both increased strength and toughness.

The low Mn concentration reduces the degree of centreline segregation and therefore the anomalous microstructures that would otherwise be formed in the strip formed by hot rolling continuously cast slabs. In addition, the plasticity of MnS inclusions is greatly reduced at low Mn concentrations. The inclusions are relatively hard and remain in a largely globular form in a hot rolled strip product. The Ti addition further enhances the hardness of MnS inclusions, whilst also assisting in achievement of improved surface quality and grain refinement in the steel and associated weld heat affected zones.

DETAILED DESCRIPTION

Figure 1:
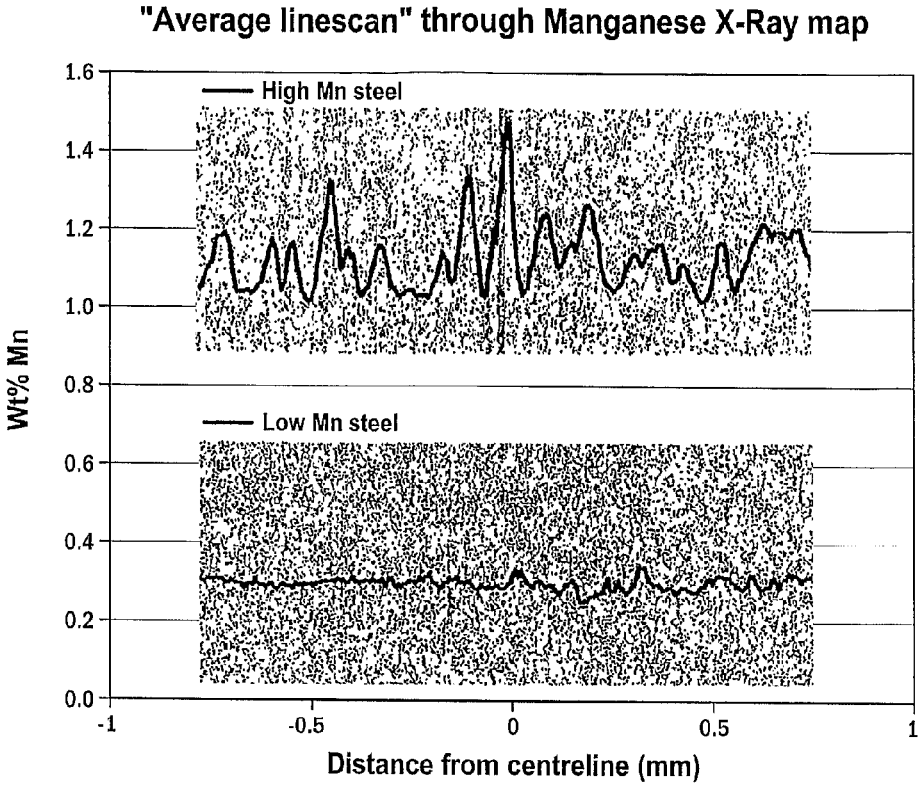
FIG. 1 illustrates graphs of the concentration of Mn versus the distance from the centerline of a steel strip for a conventional high Mn linepipe steel (top) and a linepipe steel in accordance with the present invention (bottom).

According to the present invention there is provided a linepipe steel having the following composition, in wt %:

C: up to 0.18;

Mn: 0.10 to 0.50;

Ti: at least 0.01;
Si: up to 0.35;
Nb: up to 0.10;
Al: up to 0.05;
Ca: up to 0.005;
S: up to 0.015;
P: up to 0.020;
Cr: up to 1.0;
Mo: up to 0.5;
B: up to 0.002;
Ni: up to 0.35;
Cu: up to 0.35;
V: up to 0.06;
Fe: balance; and
incidental impurities.

The term "incidental impurities" is understood herein to mean impurities that are the result of the steelmaking process and the feed materials used in the steelmaking process and are not deliberate additions to the composition and are not already in the list of elements. Sn is one such element.

The linepipe steel includes Mn and Ti as deliberate additions to the composition.

The linepipe steel may also include additional elements as deliberate additions to the composition.

Cr, Mo, B, Ni, Cu, and V are examples of additional elements.

Deliberate additions of elements may be required depending on the mechanical properties required for linepipe made from the steel. For example, for high strength linepipe grades, such as API 5L X65 and X70, which traditionally rely on relatively high Mn concentrations for strength purposes, Cr and Mo may be added to compensate for the low concentration of Mn. Furthermore, B may be added and be present in a protected solute form to enhance hardenability. It is noted that, when B is added, preferably the composition includes sufficient Ti to combine with all of the N in the composition and, hence, avoid the formation of BN.

In addition, deliberate additions of elements may be required depending on particular requirements relating to the end-use applications of the linepipe steel. For example, Ni and Cu may be required as elements in the composition for sour service applications.

Typically the steel composition includes less than 0.10 wt. % C.

Typically the steel composition includes at least 0.02 wt. % C.

Preferably the steel composition includes at least 0.03 wt. % C.

More preferably the steel composition includes at least 0.04 wt. % C.

Typically the steel composition includes less than 0.35 wt. % Mn.

Typically the steel composition includes at least 0.15 wt. % Mn.

Preferably the steel composition includes at least 0.20 wt. % Mn.

More preferably the steel composition includes at least 0.25 wt. % Mn.

Typically the steel composition includes less than 0.05 wt. % Ti.

Preferably the steel composition includes less than 0.03 wt. % Ti.

More preferably the steel composition includes less than 0.04 wt. % Ti.

Typically the steel composition includes less than 0.25 wt. % Si.

Typically the steel composition includes at least 0.005 wt. % Si.

Typically the steel composition includes less than 0.08 wt. % Nb.

Typically the steel composition includes at least 0.001 wt. % Nb.

Preferably the steel composition includes at least 0.01 wt. % Nb.

Typically the steel composition includes at least 0.01 wt. % Al.

Typically the steel composition includes less than 0.001 wt. % Ca.

Typically the steel composition includes less than 0.012 wt. % S.

Typically the steel composition includes less than 0.01 wt. % S.

Typically the steel composition includes at least 0.005 wt. % S.

Typically the steel composition includes less than 0.020% wt. P.

Typically the steel composition includes less than 0.7 wt. % Cr.

Preferably the steel composition includes less than 0.5 wt. % Cr.

Typically the steel composition includes less than 0.3 wt. % Mo.

According to the present invention there is also provided a linepipe made from the above-described linepipe steel.

According to the present invention there is also provided a method of producing a coiled strip of the above-described linepipe steel that is suitable to be used as a feedstock for producing a linepipe, which method includes the steps of:

(a) casting a slab of the above-described linepipe steel;

(b) hot rolling the slab to form a strip having a required thickness, typically 5-10 mm; and (c) coiling the strip.

Preferably the microstructure of the linepipe steel in the coiled strip produced by the above-described method is predominantly fine grained polygonal ferrite.

Preferably the microstructure includes a small (up to 15%) volume fraction of pearlite in the case of medium strength linepipe grades, such as API 5L X42 and X60.

Preferably the microstructure includes acicular ferrite and/or martensite/austenite in the case of high strength linepipe grades, such as API 5L X65 and X70.

According to the present invention there is also provided a method of producing a linepipe which includes centre-slitting a linepipe steel to form a length of slit steel strip, and electric resistance welding the above-described linepipe steel strip and forming the linepipe.

Apart from the narrow seam annealed region of the ERW weld zone, the microstructure of the linepipe is essentially unchanged by the pipe forming process and is the same as that of the linepipe steel in the above-described linepipe steel strip.

The applicant has carried out research work that has evaluated the extent of centerline segregation in linepipes made from the above-described electric resistance welded linepipe steel strip and linepipes made from electric resistance welded, conventional high Mn linepipe steel strip.

As mentioned above, centreline segregation and the resultant anomalous microstructures can have deleterious effects on the chemical properties of electric resistant welded linepipe steel strip, particularly when linepipes are produced from centre slit strip feed.

FIG. 1 illustrates the results of the research work.

FIG. 1 comprises two graphs. Each graph plots the concentration of Mn (measured by Electron Probe Microanalysis) in the particular steel tested against distance from the centerline of the steel strip.

The upper graph of FIG. 1 is for a conventional high Mn linepipe steel with a Mn concentration of 1.1 wt. %.

The lower graph of FIG. 1 is for a linepipe steel in accordance with the present invention with a low Mn concentration of 0.3 wt. %.

It is readily apparent from a comparison of the two graphs that there was significantly less variation in Mn concentration in the vicinity of the strip centerline for the linepipe steel in accordance with the present invention. This indicates significantly less segregation in this linepipe steel. Consequently, the toughness of the ERW weld line for pipes made from centre slit strip can be significantly improved.

Specifically, the lower graph in FIG. 1 (i.e. for linepipe steel in accordance with the present invention) shows that the Mn concentration was substantially constant across the width of the steel strip sample. In addition, the upper graph of FIG. 1 (i.e. a conventional linepipe steel) shows that there was a significant peak in Mn concentration at the centreline of the steel strip sample tested and significant variations in Mn concentration across the width of the sample. As mentioned above, when steel strips made from conventional linepipe steels are centre-slit and each resulting slit strip is formed into a pipe shape and welded along the butting longitudinal edges to form the pipe, there can be deleterious effects on the mechanical properties, such as toughness, along the weld lines of the pipes due to anomalous microstructures at the centreline of the strip. Pipes made from centre-slit steel having a low Mn concentration (e.g., no more than 0.50 wt. %) have a reduced degree of centreline segregation and therefore a reduced degree of the anomalous microstructures that would otherwise be formed.

The improved toughness is illustrated by the results of further research work that are summarized in Table 1 below.

Table 1 provides the results of weld line Charpy V impact tests on "gull-winged" wall thickness specimens produced from 219 mm×6.4 mm pipe made from a conventional high Mn linepipe steel and a low Mn linepipe steel in accordance with the present invention. The tests were made with the test specimens positioned with their notch locations coincident with the weld lines. The chemical compositions of both the high Mn and the low Mn steel pipes tested in this way are provided in Table 2.

TABLE 1

Weld Line Charpy V Impact Tests

| Steel Type | Test Pipe Number | Charpy V Impact Energy (J) at 0° C. (3 tests per pipe) | | |
|---|---|---|---|---|
| Present Invention | 1 | 82 | 128 | 104 |
| (0.08% C—0.38% Mn) | 2 | 130 | 128 | 132 |
| | 3 | 96 | 98 | 88 |
| Conventional High Mn | 1 | 17 | 22 | 48 |
| (0.08% C—1.07% Mn) | 2 | 20 | 22 | 24 |
| | 3 | 20 | 12 | 30 |

TABLE 2

Chemical Composition of Pipes Subject to Weld Line Charpy V Tests (wt %)

| Steel | C | Mn | Si | S | Al | Nb | Ti | Ca | N |
|---|---|---|---|---|---|---|---|---|---|
| Low Mn (Invention) | 0.08 | 0.38 | 0.19 | 0.004 | 0.029 | 0.018 | 0.021 | 0.0008 | 0.0043 |
| High Mn (Conventional) | 0.08 | 1.07 | 0.33 | 0.003 | 0.045 | 0.055 | 0.013 | 0.0007 | 0.0047 |

The results in Table 1 are typical weld line Charpy test results obtained by the applicant in the research work.

It is evident from Table 1 that the linepipe steel of the present invention had weld line toughness consistently higher than for the conventional high Mn linepipe steel tested.

The research work carried out by the applicant investigated further the effect of low Mn concentrations on the Charpy V impact energy of linepipe steel strip in accordance with the present invention.

Figure 2:
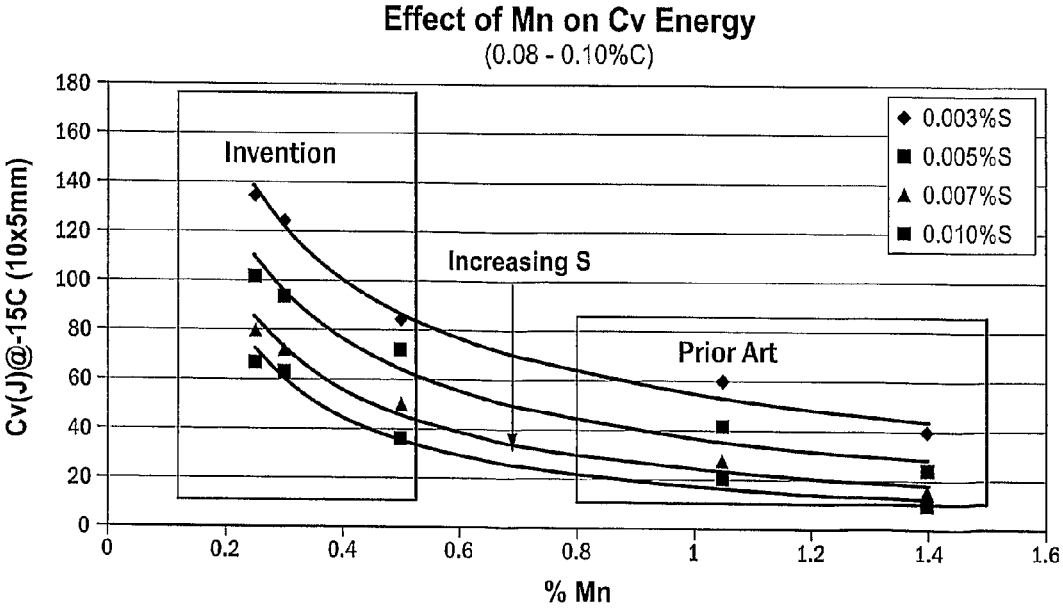
FIG. 2 is a graph of Charpy V Energy at −15° C. versus the Mn concentrations (in wt. %) of a number of linepipe strips in which the C content was held in the range of 0.08-0.10% and the S content was varied over the range of 0.003 to 0.010%.

The results of the further research work are presented in FIG. 2.

FIG. 2 is a graph of Charpy V Energy at −15° C. versus the Mn concentrations (in wt. %) of a number of linepipe strips in which the C content was held in the range of 0.08-0.10% and the S content was varied over the range of 0.003 to 0.010%.

FIG. 2 shows that low Mn steels of the present invention can tolerate higher concentrations of S than higher Mn steels to obtain a given toughness. This is an advantage from the viewpoint of the practical issue of making steel with low S concentrations. In other words, it is apparent from FIG. 2 that the low Mn alloy design approach of the present invention permits considerably higher S concentrations to be used to achieve a given specification requirement for Charpy V impact energy.

Many modifications may be made to the present invention described above without departing from the spirit and scope of the invention.

What is claimed is:

1. A method of producing a linepipe which includes the steps of:

(a) centre-slitting a linepipe steel strip to form a length of slit steel strip, wherein the linepipe steel has the following composition, in wt. %:
C: greater than 0.04 and up to 0.18;
Mn: 0.10 to up to 0.38;
Ti: at least 0.01;
Si: up to 0.35;
Nb: up to 0.018;
Al: up to 0.05;
Ca: up to 0.005;
S: at least 0.004 and up to 0.015;
P: up to 0.020;
Cr: up to 1.0;
B: up to 0.002;
Ni: up to 0.35;
Cu: up to 0.35;
V: up to 0.06;
Fe: balance; and
incidental impurities; and (b) forming the length of slit steel strip into a pipe and electric resistance welding lengthwise extending side edges together to form the linepipe, wherein the linepipe has a weld line toughness of at least 80 J, as measured in Charpy V Impact tests at 0° C., and wherein the microstructure of the linepipe is essentially unchanged by the pipe forming step (b) and is the same as that of the linepipe steel strip before the centre-slitting step (a).

2. The method defined in claim 1, wherein the linepipe steel includes at least 0.25 wt. % Mn.

3. The method defined in claim 1, wherein the linepipe steel includes at least 0.005 wt. % Si.

4. The method defined in claim 1, wherein the linepipe steel includes at least 0.005 wt. % S.

5. The method defined in claim 4, wherein the linepipe steel includes at least 0.010 wt.% S.

6. The method defined in claim 1, wherein the linepipe steel includes less than 0.35 wt. % Mn.

7. The method defined in claim 1, wherein the linepipe steel includes less than 0.05 wt. % Ti.

8. The method defined in claim 7, wherein the linepipe steel includes less than 0.03 wt. % Ti.

9. The method defined in claim 1, wherein the linepipe steel includes less than 0.25 wt. % Si.

10. The method defined in claim 1, wherein the linepipe steel includes at least 0.001 wt. % Nb.

11. The method defined in claim 10, wherein the linepipe steel includes at least 0.01 wt. % Nb.

12. The method defined in claim 1, wherein the linepipe steel includes at least 0.01 wt. % Al.

13. The method defined in claim 1, wherein the linepipe steel includes less than 0.001 wt. % Ca.

14. The method defined in claim 1, wherein the linepipe steel includes less than 0.012 wt. % S.

15. The method defined in claim 1, wherein the linepipe steel includes less than 0.7 wt. % Cr.

16. The method defined in claim 15, wherein the linepipe steel includes less than 0.5 wt. % Cr.

17. The method defined in claim 1, wherein the linepipe steel includes 0.08-0.10 wt. % C.

18. The method defined in claim 1, wherein the linepipe steel includes 0.38 wt. % Mn.

19. The method defined in claim 1, wherein the linepipe steel includes 0.08-0.10 wt. % C and 0.3 wt. % Mn.

* * * * *